US005472118A

United States Patent [19]

Nelson

[11] Patent Number: 5,472,118

[45] Date of Patent: Dec. 5, 1995

[54] COLLAPSIBLE TUBE WINDER AND LOCK DEVICE

[76] Inventor: Monte G. Nelson, 170 E. 100 South, American Fork, Utah 84003

[21] Appl. No.: 202,153

[22] Filed: Feb. 25, 1994

[51] Int. Cl.[6] ..... B65D 35/32

[52] U.S. Cl. ..... 222/99; 222/153.01

[58] Field of Search ..... 222/95, 99, 100, 222/153

[56] References Cited

U.S. PATENT DOCUMENTS

| | | | |
|---|---|---|---|
| 2,903,162 | 9/1959 | Regan | 222/99 |
| 3,628,696 | 12/1971 | Duiker | 222/99 |
| 5,094,362 | 3/1992 | Dickens | 222/99 |

FOREIGN PATENT DOCUMENTS

| | | | |
|---|---|---|---|
| 2482929 | 11/1981 | France | 222/99 |
| 9401336 | 1/1994 | WIPO | 222/99 |

*Primary Examiner*—Andres Kashnikow
*Assistant Examiner*—Joseph A. Kaufman
*Attorney, Agent, or Firm*—Brady, O'Boyle & Gates

[57] ABSTRACT

A collapsible tube winder and lock device wherein the winder includes a slotted key member for receiving the crimped closed end of a collapsible tube, the contents of the tube being dispensed by turning the key to wind the tube around the key to thereby squeeze the contents from the tube. The lock device includes an arm having depending legs detachably connected to the winder. The arm engages a wound portion of the collapsible tube to prevent the tube from unwinding itself from the winder.

5 Claims, 2 Drawing Sheets

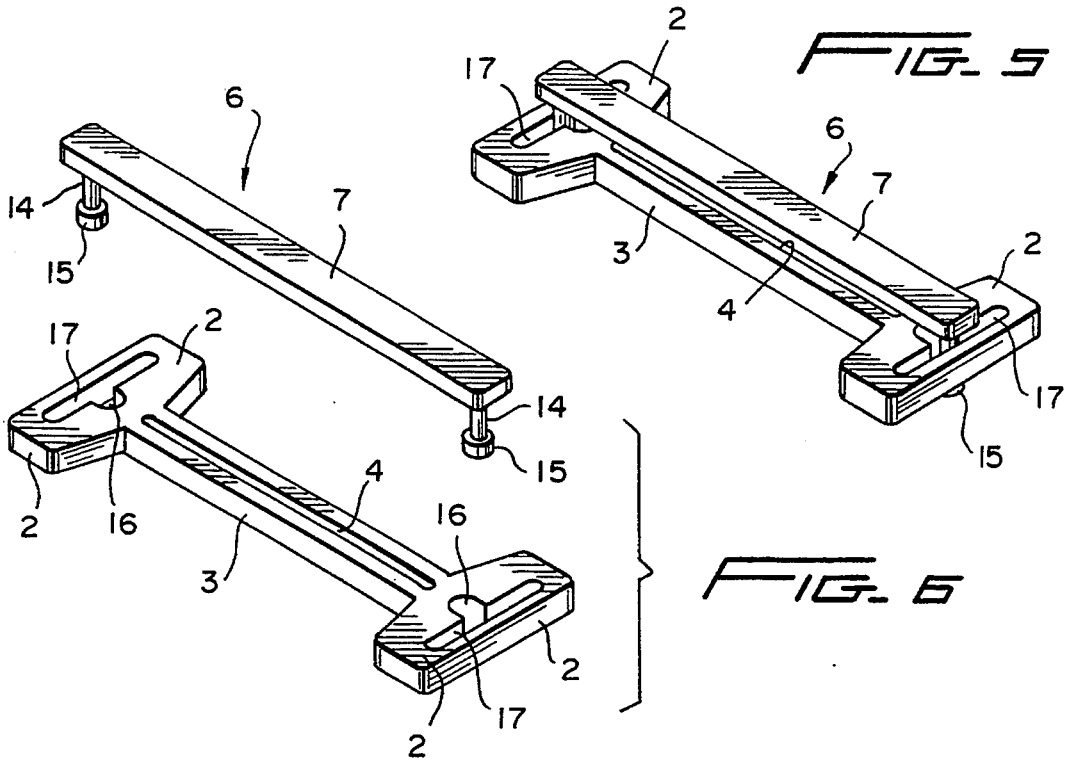
FIG. 5
FIG. 6
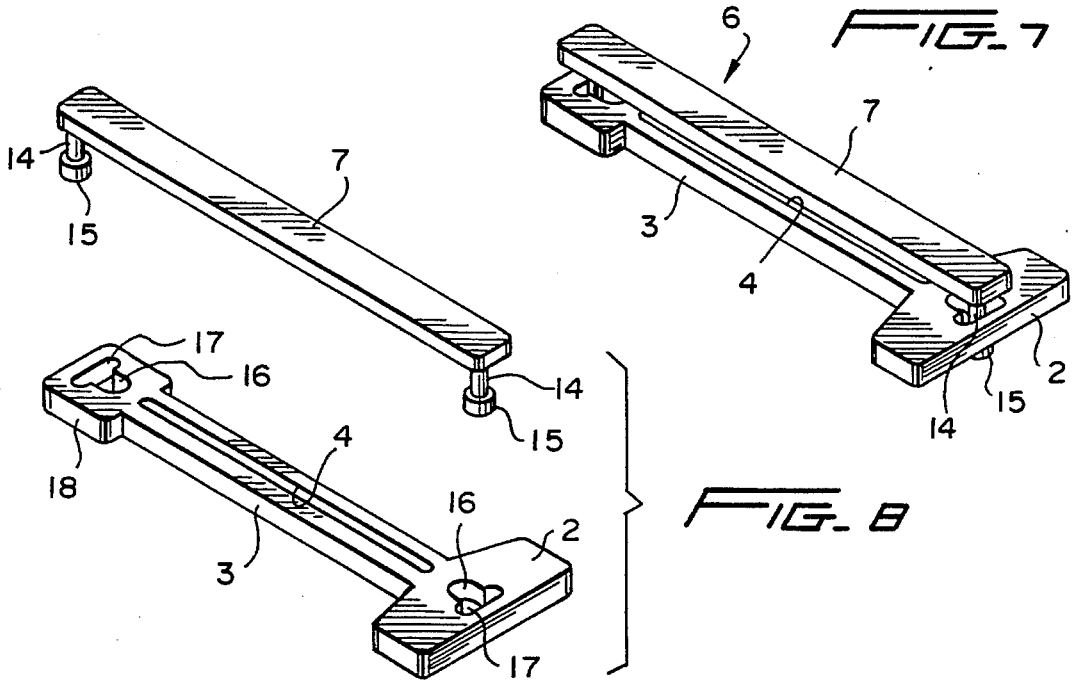
FIG. 7
FIG. 8

COLLAPSIBLE TUBE WINDER AND LOCK DEVICE

BACKGROUND OF THE INVENTION

Various winders have been proposed to facilitate the dispensing of viscous fluid material such as toothpaste, medicaments, grease, and the like, from a collapsible tube in which the material is packaged. These winders usually consist of a key having a slot provided in the key shank into which the crimped, closed end of the tube is inserted. The material is dispensed from the tube by manually turning the key to thereby wind the tube around the key shank, whereby the key shank provides a mandrel for winding and collapsing the tube thereon to thereby squeeze the material therefrom. With the introduction of collapsible tubes made of plastic, there has been a tendency for the tubes to return to the original un-collapsed state resulting in the tube unwinding itself from the key, thus requiring a rewinding of the key to dispense additional material from the tube. To prevent this unwinding of the tube, it has been proposed to provide the winder with a roller as disclosed in U.S. Pat. No. 3,628,696, dated Dec. 21, 1971, or a wire locking bracket as disclosed in U.S. Pat. No. 5,094,362. While these winders and associated locking or holding devices have been satisfactory for their intended purposes, they have been characterized by a certain disadvantage in that, by their construction and arrangement, the locking devices are connected to the key or mandrel and are adapted to bear against the wall of the collapsible tube during the wind-up operation, thus making it somewhat difficult to manually turn the key or mandrel.

SUMMARY OF THE INVENTION

To overcome the disadvantages experienced by heretofore employed tube winders having holding or locking devices connected thereto, the winder and lock device of the present invention has been devised, and comprises, essentially, a key member having at least one head on an end of a shank portion having a slot provided therein. Each end of the key member is provided with an opening for receiving leg members depending from each end of an arm positioned above and parallel to the shank portion of the key member.

In use, the crimped closed end of a collapsible tube containing a viscous fluid is inserted into the slotted shank portion of the key member. To dispense the fluid from the tube, the key member is manually turned to wind the tube around the shank portion, to thereby collapse the tube to squeeze the contents therefrom. After the desired amount of fluid has been dispensed from the tube, the arm is positioned over the wound portion of the tube and the depending leg members are inserted into the openings on each end of the key member, whereby the arm lockingly engages the wound portion of the collapsible tube to prevent the tube from unwinding from the key.

By the construction and arrangement of the winder and lock device of the present invention, the lock device is connected to the winder only after the collapsible tube has been wound, whereby the turning of the collapsible tube on the shank portion of the key is facilitated since there is no interference from the locking device during the winding operation.

BRIEF DESCRIPTION OF THE DRAWINGS

FIG. 5 is a perspective view of another embodiment of the winder and lock device of the present invention;

FIG. 6 is an exploded perspective view of the winder and lock device shown in FIG. 5;

FIG. 7 is a perspective view of yet another embodiment of the winder and lock device of the present invention; and FIG. 8 is an exploded, perspective view of the winder and lock device shown in FIG. 7.

DESCRIPTION OF THE PREFERRED EMBODIMENTS

Figure 1:
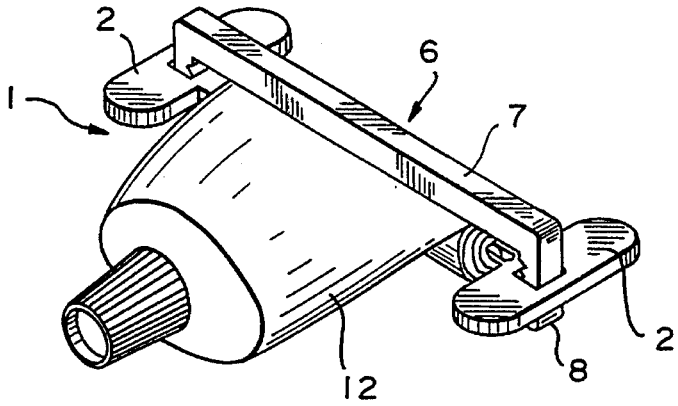
FIG. 1 is a perspective view of one embodiment of the winder and lock device of the present invention having a wound collapsible tube connected thereto.
Figure 2:
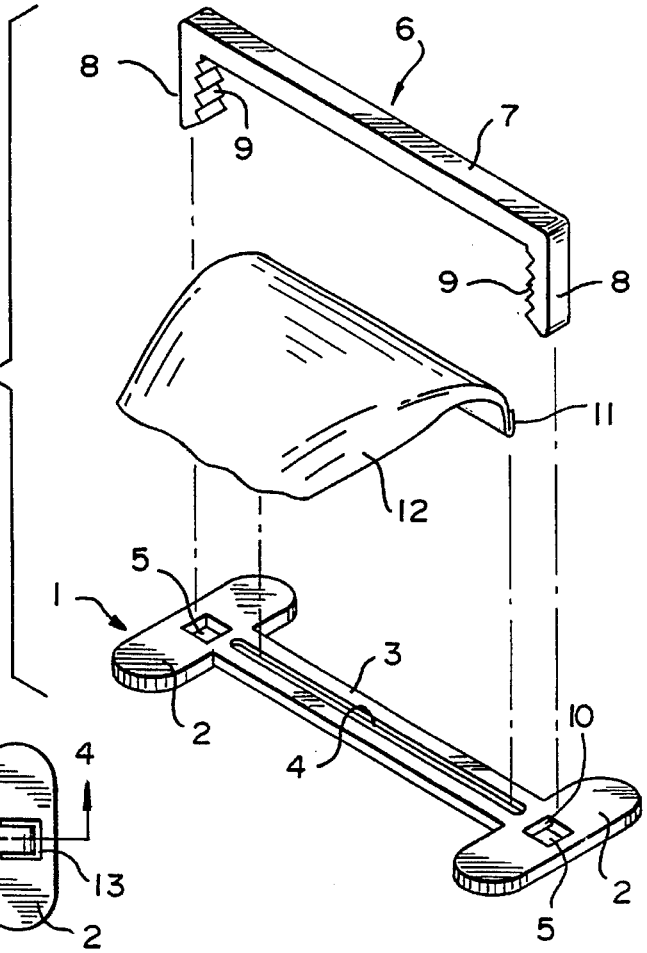
FIG. 2 is an exploded, fragmentary, perspective view of the winder and lock device shown in FIG. 1.
Figure 3:
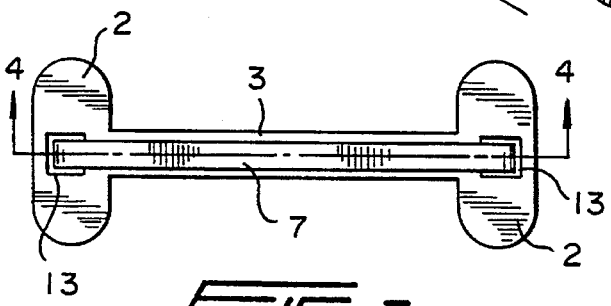
FIG. 3 is a top plan view of the winder and lock device shown in FIG. 1, with the collapsible tube removed therefrom.
Figure 4:
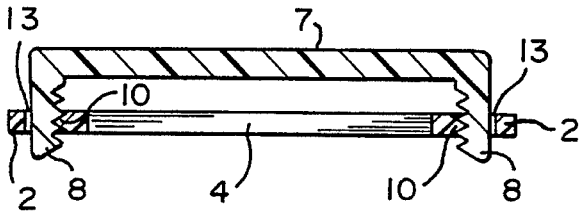
FIG. 4 is a view taken along line 4—4 of FIG. 3.

Referring to the drawings and more particularly to FIGS. 1 to 4, the winder 1 of the present invention comprises a key member having a head 2 integral with each end of a shank portion 3 having a longitudinally extending slot 4 provided therein. Each end of the key member is provided with an opening 5 extending through the heads 2, and spaced outwardly from the ends of the slot 4.

The lock device 6 of the present invention comprises an arm 7 having depending, resilient leg members 8 integral with each end of the arm 7. The inwardly facing surfaces of the leg members 8 are provided with teeth 9 engageable with outwardly facing bevelled edges 10 provided on a side wall of the opening 5.

In use, the closed crimped end 11 of a collapsible tube 12 containing a viscous fluid is inserted into the shank slot 4 of the winder 1, and the winder is manually turned to wind the tube 12 on the shank portion 3, to thereby collapse the tube while squeezing the contents therefrom. In order to hold the wound tube 12 on the winder 1, the lock device 6 is connected to the winder 1 by inserting the leg members 8 through the openings 5. The teeth 9 on each leg member 8 ratchet over the bevelled edges 10 in the openings 5 until the arm 7 engages the wall of the collapsible tooth, whereupon the teeth 9 grip the bevelled edges 10, to thereby lock the arm 7 on the winder.

The openings 5 have a larger cross-sectional dimension than the leg members 8, to thereby provide a clearance 13 so that the lock device 6 can be removed from the winder 1 by manually spreading the legs 8 laterally outwardly to disengage the teeth 9 from the bevelled edges 10. The key member can then be wound further to dispense additional material from the tube, after which the lock device 6 is connected to the winder 1 as described hereinabove.

FIGS. 5 and 6 illustrate another embodiment of the invention wherein the locking device arm 7 is provided with legs 14 integral with and depending from each end of the arm 7. The lower end of each leg 14 is provided with a circular foot 15 adapted to be inserted through an arcuate opening 16 provided in each of the key heads 2. Each opening 16 communicates with a slot 17 provided in each head 2, each slot 17 extending transversely to the shank portion 3.

In use, the closed, crimped end of a collapsible tube is inserted into the shank slot 4, and the winder is manually turned to wind the tube on the shank portion 3, as described hereinabove in connection with the embodiment of FIG. 1. The lock device is then connected to the winder by inserting the leg members 14 and associated feet 15 through the arcuate openings 16, and then sliding the arm 7 and associated legs to either end of the slots 17 so that the feet 15 engage the surface of the key heads 2 adjacent the slots on each side thereof to thereby lock the arm 7 to the winder. To remove the lock from the winder, the arm 7 is moved to the position shown in FIG. 5 wherein the feet 15 are aligned with the arcuate openings 16 so that the legs 14 and associated feet 15 can be pulled through the arcuate openings 16, to thereby release the lock device from the winder.

FIGS. 7 and 8 illustrate yet another embodiment of the invention which is similar to the embodiment shown in FIGS. 5 and 6 except the shank 3 is provided with only a single key head 2 at one end thereof, the opposite end of the shank 3 merely having an enlarged portion 18 containing the arcuate opening 16 and slot 17.

From the above description, it will be readily apparent by those skilled in the art that the winder and lock device of the present invention is an improvement over prior winder and lock combinations since the lock device of the present invention is connected to the winder only after the collapsible tube has been wound, whereby the turning of the collapsible tube on the shank portion 3 of the key is facilitated since there is no interference from the locking device 6 during the winding operation.

The winder and lock device can be made of molded plastic; it is of simple construction with few parts, thus, not likely to become inoperative even after long and continued use.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. In combination, a winder and a lock device for a collapsible tube, said tube having a closed, crimped end and a discharge end, said winder comprising, a key member having a shank portion, a longitudinally extending slot extending through said shank portion for receiving the crimped, closed end of the collapsible tube, at least one head integral with an end of said shank portion to facilitate the manual winding of the collapsible tube on said shank portion to squeeze the contents of the tube through said discharge end, and an opening extending through each end of said shank portion and spaced outwardly from each end of said slot, each opening being aligned and coplanar with said slot; said lock device comprising, an arm spaced above said shank portion and extending parallel thereto, a resilient leg member integral with each end portion of the arm and depending therefrom, and teeth on said depending leg members biased into engagement with a side wall in each opening for releasably connecting the lock device to the winder, whereby after the tube has been wound on the shank portion, the lock device is connected to the winder by inserting the depending legs into the openings, to thereby hold the arm against a wall portion of the wound tube to prevent the tube from unwinding itself from the shank portion.

2. The combination of a winder and lock device according to claim 1, wherein the side walls of said openings are provided with bevelled edges engaged by said teeth means.

3. The combination of a winder and lock device according to claim 1, wherein the openings have a larger cross-sectional dimension than the leg members, to thereby provide a clearance between the leg members and side walls of said openings opposite from the first-mentioned side walls, whereby the legs can be moved laterally relative to the clearance to remove the teeth from engagement with side walls of the openings, to thereby disconnect the lock device from the winder.

4. The combination of a winder and lock device according to claim 1, wherein the head is integral with each end of the shank portion.

5. In combination, a winder and a lock device for a collapsible tube, said tube having a closed, crimped end and a discharge end, said winder comprising, a key member having a shank portion, a longitudinally extending slot extending through said shank portion for receiving the crimped, closed end of the collapsible tube, at least one head integral with an end of said shank portion to facilitate the manual winding of the collapsible tube on said shank portion to squeeze the contents of the tube through said discharge end, and an opening extending through each end of said shank portion and spaced outwardly from each end of said slot; said lock device comprising, an arm spaced above said shank portion and extending parallel thereto, a leg member integral with each end portion of the arm and depending therefrom, and a circular foot integral with the lower end of each depending leg cooperating with said openings for releasably connecting the lock device to the winder, each opening having an arcuate portion communicating with a slot extending transversely to the shank portion, the arcuate portion of the opening and associated slot portion being dimensioned to allow the leg and associated foot to be inserted through said opening, the portion of the transverse slot on each side of the arcuate portion having a lateral dimension less than the diameter of the circular foot for holding the locking device on the winder, whereby after the tube has been wound on the shank portion, the lock device is connected to the winder by inserting the depending legs into the openings, to thereby hold the arm against a wall portion of the wound tube to prevent the tube from unwinding itself from the shank portion.

* * * * *